United States Patent [19]

Silverthorne et al.

[11] Patent Number: 4,673,019

[45] Date of Patent: Jun. 16, 1987

[54] GARAGE DOOR SCREEN ENCLOSURE

[76] Inventors: Daniel F. Silverthorne; Claude H. M. Hare; Dale Hall, all of R.R. #9, Dunnville, Ontario, Canada, N1A 2W8

[21] Appl. No.: 833,150

[22] Filed: Feb. 27, 1986

[30] Foreign Application Priority Data

Feb. 27, 1985 [CA] Canada ..... 475314

[51] Int. Cl.[4] ..... A47H 3/00

[52] U.S. Cl. ..... 160/268 R; 160/290 F; 160/309

[58] Field of Search ..... 160/268 R, 242, 349 R, 160/238, 290 E, 310, 309

[56] References Cited

U.S. PATENT DOCUMENTS

| | | | |
|---|---|---|---|
| 1,715,858 | 6/1929 | Nelson | 160/290 F |
| 1,959,136 | 5/1934 | Miller | 160/268 R |
| 3,421,568 | 1/1969 | Youngs | 160/310 |
| 4,249,589 | 2/1981 | Loeb | 160/368 R |
| 4,294,302 | 10/1981 | Ricke | 160/309 X |
| 4,478,268 | 10/1984 | Palmer | 160/310 |

FOREIGN PATENT DOCUMENTS

| | | | |
|---|---|---|---|
| 1459053 | 12/1976 | United Kingdom | 160/238 |

*Primary Examiner*—Robert W. Gibson, Jr.

*Attorney, Agent, or Firm*—Cushman, Darby & Cushman

[57] ABSTRACT

A roll-up apparatus comprises a rod having one edge of a flexible screen thereto and means to rotatably mount the rod to a garage door frame. The screen is provided with means to releasably attach its side edges to the side members of the garage door frame, and means to maintain its bottom edge in contact with the ground when the screen is in a lowered position.

4 Claims, 1 Drawing Figure

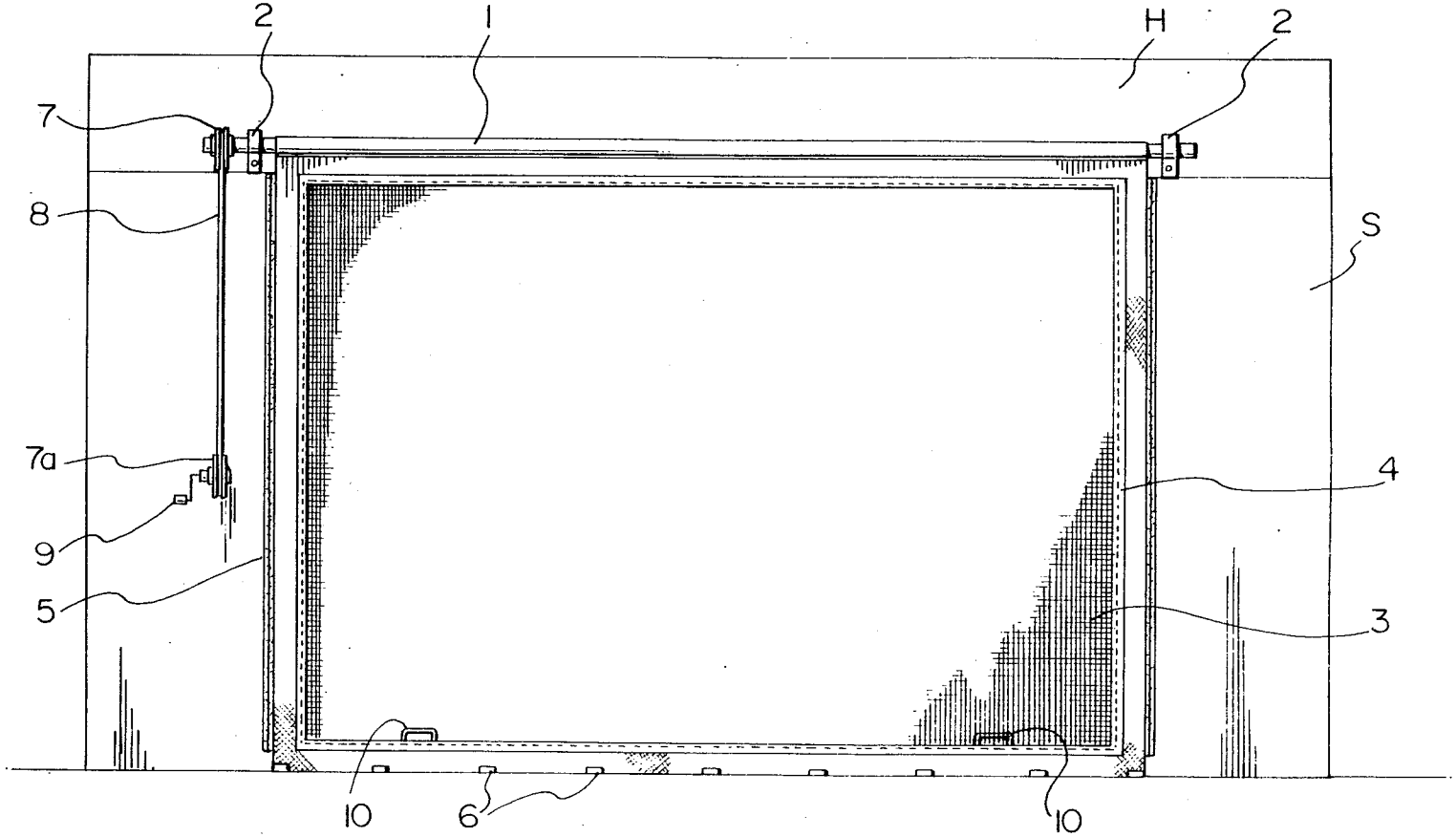
S
2
H
1
2
7
8
7a
9
5
4
3
10
9
10

GARAGE DOOR SCREEN ENCLOSURE

The present invention relates to the field of garage door closures, and in particular provides a screen enclosure for a garage.

Most houses in North America are provided with a garage. Normally, the garage is used strictly as a storage and work area. It is provided with a sturdy, usually lockable, steel or wooden door to close the principal entrance to the garage through which a motor vehicle can usually be driven and it is also provided, in most cases, with a second, more conventional, door.

The present invention takes advantage of the large automobile-size door provided in most garages, and the fact that this door can usually be moved well out of the way when it is opened and provides a means for utilizing a garage as a recreational area, at relatively low cost.

In one broad aspect, the present invention relates to a roll-up apparatus comprising a rod having one edge of a flexible screen thereto and means to rotatably mount the rod to a garage door frame, the screen being provided with means to releasably attach its side edges to the side members of said garage door frame, and means to maintain its bottom edge in contact with the ground when said screen is in a lowered position.

In drawings which illustrate, by way of example, the present invention:

FIG. 1 is a rear view of an embodiment of the present invention, installed in a garage door frame.

Referring, then to FIG. 1, a typical garage door frame is comprised of a header H and a pair of sides S. The bottom of the frame is generally co-extensive with the ground G, and is often the asphalt or concrete surface of a driveway, or a concrete slab surface of a garage floor.

The present invention provides a rod 1, mounted on a spaced pair of brackets 2, which brackets are located on the upper corners of a garage door frame, securely screwed or otherwise fastened to the header. A screen 3, preferably manufactured from fibre-glass is connected to the rod, along its entire length. The screen extends from the rod, to the ground, and from side to side across the garage door frame to provide a screen enclosure for the garage.

The perimeter of the fibre-glass is provided with a reinforcing margin 4, of any suitable material, such as vinyl sheeting, canvas or the like. The reinforcing margin may be sewn to the screen, or attached to the screen by means of an adhesive. Along the side edges of the screen, adjacent the inside surface of the sides of the garage door frame, a strip 5 of one-half of a hook and pile fastener combination is sewn to the fabric of the reinforcing margin. The other half of the hook and pile fastener combination is secured to the inside surface of the sides of the garage door frame F. This may be done by a suitable adhesive. It will be seen then, that when the screen is lowered, the side edges of the screen may be releasably fastened to the side edges to the inside surface of the garage door frame, to create a seal which is substantially inpenetrable by insects.

The lower edge of the screen may be provided with a series of snaps (not shown), for fastening to complementary snaps embedded in the ground or the floor of the garage. However, it is more desirable to provide a series of weights 6 sewn into the bottom edge of the fabric along the lower edge of the screen, so that when the screen is lowered to its maximum extent, it will remain solidly against the ground, and will not permit insects to enter.

One end of the supporting rod extends outwardly from its associated bracket somewhat, and is provided with a radially extending driving member, such as a pulley wheel 7. Directly below this member, a second driving member 7*a* is mounted for rotation on the garage door frame, and is connected to the member on the rod by a drive belt 8. A crank 9 is provided in the lower drive member, so that the screen enclosure may be raised and lowered by means of the crank. Alternatively, a motor may be provided in association with the lower drive member. This motor is not illustrated in the drawings.

It will also be understood that the pulley wheel drive members 7, 7*a* described above may be replaced with toothed sprockets, and the drive belt described may be replaced with a chain. The drive belt arrangement is, however, preferred as it is less noisy than a drive chain arrangement. It will also be noted that a pair of handles 10 is provided along the bottom edge of the screen in a preferred embodiment.

In order to utilize the screen enclosure of the present invention, the user merely grasps handles provided on the lower edge of the screen enclosure and draws the screen to the ground. He then fastens the hook and pile closures provided on the side edges of the screen to the hook and pile closures on the garage door frame. As noted above, the crank may be utilized to lower the screen, and this feature facilitates use of the present invention by persons who are not tall enough to reach the header of a garage door frame without the use of a ladder or like apparatus.

The screen of the present invention is raised by merely unfastening the hook and pile closures along the sides of the screen, and then rolling the screen up by means of the crank. The screen may be fastened in the "up" position by immobilizing the crank. This is done by conventional means.

We claim:

1. A roll up apparatus comprising:

a rod having one edge of a flexible screen attached thereto, means to rotatably mount the rod to a garage door frame, the screen being provided with means to releasably attach its side edges to the side members of said garage door frame, and means to maintain its bottom edge in contact with the ground when said screen is in a lowered position, wherein one end of said rod is provided with a radially extending member for engaging a flexible drive member, and there is provided, on said garage door frame, beneath the radially extending member on said rod, a drivable member for engaging said flexible rod, to raise or lower said screen, wherein the means for attaching the side edges of said screen to said garage door frame comprises complementary pairs of hook and pile fasteners, connected to said side edges of said screen, and said garage door frame respectively, wherein the radially extending means on said rod comprises a pulley wheel, the driving means on said garage door frame comprises a second pulley wheel and the flexible driving means extending therebetween comprises and endless belt, wherein said driving means mounted on said garage door frame is driven by a motor, and wherein the means for maintaining the lower edge of said screen in contact with the ground comprisies a series of snaps sewn into the lower edge of said screen, therebeing a complementary series of snaps embedded in the ground at appropriate locations.

2. A roll-up apparatus as claimed in claim 1 wherein said driving means mounted on said garage door frame is provided with a hand crank.

3. A roll-up apparatus as claimed in claim 1 wherein the means for maintaining the bottom of said screen in contact with the ground comprises a series of weights sewn into the bottom of said screen.

4. A roll-up apparatus as claimed in claim 1 wherein there is provided a marginal edge, around the perimeter of said screen, of reinforcing material.

* * * * *